US005329699A

United States Patent [19]

McCoy

[11] Patent Number: 5,329,699

[45] Date of Patent: Jul. 19, 1994

[54] METHOD AND APPARATUS FOR PRESERVING FOR FURTHER USE RAZOR BLADE CUTTING EDGES

[76] Inventor: Charles B. McCoy, 242 County Fair, Houston, Tex. 77060

[21] Appl. No.: 968,297

[22] Filed: Oct. 29, 1992

[51] Int. Cl.[5] ..... A45D 27/00

[52] U.S. Cl. ..... 30/34.05; 30/74

[58] Field of Search ..... 30/34.05, 41, 74, 90

[56] References Cited

U.S. PATENT DOCUMENTS

| | | | |
|---|---|---|---|
| 1,495,921 | 5/1924 | Moulton | 30/74 |
| 1,529,316 | 3/1925 | Lovegrove | 30/74 |
| 1,775,518 | 9/1930 | Forbes | 30/90 |
| 1,782,033 | 11/1930 | Forbes | 30/74 |
| 1,914,925 | 6/1933 | Nones | 30/74 |
| 2,792,108 | 5/1957 | Keller | 30/90 |
| 3,031,757 | 5/1962 | Kramer | 30/74 |

FOREIGN PATENT DOCUMENTS

| | | | |
|---|---|---|---|
| 127158 | 5/1919 | United Kingdom | 30/90 |
| 759926 | 10/1956 | United Kingdom | 30/74 |

OTHER PUBLICATIONS

"Magnetism"-An Introductory Survey, p. 171, 1970 by E. W. Lee, Dover Publication, Inc., New York.

*Primary Examiner*—Richard K. Seidel
*Assistant Examiner*—Hwei-Siu Payer
*Attorney, Agent, or Firm*—Sue Z. Shaper

[57] ABSTRACT

Apparatus and method for extending the life of a blade cutting edge including a unit having at least two oppositely charged permanent magnet polar surfaces, the unit defining a receptacle area for holding a blade wherein the oppositely charged polar surfaces and the receptacle area are oriented with respect to each other so that a length of a cutting edge of a blade held in the receptacle would be held in close proximity to at least one polar surface, the plane of that blade would be aligned to coincide with strong magnetic lines of force existing between the at least two oppositely charged polar surfaces and the coinciding lines of force would pass through the cutting edge and turn in the blade.

7 Claims, 2 Drawing Sheets

METHOD AND APPARATUS FOR PRESERVING FOR FURTHER USE RAZOR BLADE CUTTING EDGES

BACKGROUND OF THE INVENTION

Razor blades used in safety razor systems have a very short useful shaving life. This short life is the result of corrosion damage which is the main cause of dull edge razor blades. Corrosion occurs when free electrons from the metal blade flow across a boundary into a contacting water shaving solution. Razor blades are normally comprised of ferromagnetic material conductors with large numbers of these free electrons. Free electrons are mobile electrons and are not to be confused with planetary electrons. Planetary electrons are held within the atom by strong electrostatic forces while free electrons move randomly within the conductor. This random movement causes collisions with atoms which is how electrical energy is transmitted through a metal conductor.

Corrosion is an electrochemical attack of a metal surface which most often occurs in the presence of water and oxygen. Razor blade cutting edge corrosion is wet corrosion which begins in the form of rusting when water shaving solutions are allowed to remain on the unprotected areas of the cutting edge material surface. The razor blade has a sharp cutting edge and free electrons accumulate along the sharp edges of a metal conductor. Different parts of the cutting edge surface accumulate more electrons than others and act like electrodes. This electrode like action begins to release free electrons from the cutting edge thereby forming metallic ions. These metallic ions are then absorbed by ions in the electrolyte water shaving solution. This metallic ion absorption by ions in the electrolyte solution cause the dissolution of the metal cutting edge. Dissolution is the taking up of a substance by a liquid. This dissolution process begins at the free electron discharge points. The process of dissolution causes small metal particles to break off the razor blades fine cutting edge forming pits. Loss of these small particles allows the electrolyte water shaving solution to penetrate them metal cutting edge and increases the rate of dissolution. This dissolution causes a condition known as accelerated pitting. As the pitting increases, larger particles begin to break off the fine cutting edge causing corrosion pitting damage. This corrosion pitting damage changes the razor blades sharp cutting edge into a jagged irregular dull edge shaving surface. This corrosion pitting damage is one of the most difficult types of corrosion to prevent. The problem of corrosion rusting end pitting has changed the way safety razor blades are manufactured. The long utilized high carbon steels used in the manufacturing of razor blades provided a superior quality shave. They were replaced by corrosion resistant stainless steel blades. Stainless steel alloys, however, are more susceptible to corrosion pitting damage then any other group of metal alloys. Stainless steel razor blades have a shaving life three times longer then those made of high carbon steel. Stainless steel blades, however, do not provide as comfortable a shave. Polymer sprayed and baked on protective coatings were developed to decrease this discomfort. This method improved the sliding lubrication of the cutting edge end helped prevent corrosion damage. Metal films were also applied to the sharp cutting edge by a process known as sputtering. Sputtering is the electronic application of a metal alloy surface film in an effort to preserve the sharp cutting edge of the safety razor blade. These metal films reduce friction and prevent corrosion; however, these metal end polymer film coatings are soon damaged during the shaving process. The sliding contact between beard, blade, end shaving additives cause scratches in these films. These scratches leave the cutting edge surface metal open to electrochemical corrosion attack in the form of rusting and pitting damage.

Several inventions for use by consumers have been patented in the United States to increase the useful shaving life of metal safety razor blade shaving devices.

U.S. Pat. No. 3,516,209, granted to Virtanen, uses a built-in attachment to strop a razor blade. This sliding action would sharpen a blades cutting edge and remove any corrosion problems. This invention requires movement back and forth over a blade and is inefficient.

U.S. Pat. No. 3,736,243, granted to Duggan, uses a DC battery and electricity to flow electrons over the conducting surface of the metal blade to stop electrochemical corrosion damage to the blade. This invention exposes the consumer to electrical shock and frequent and expensive replacement of DC batteries.

U.S. Pat. No. 4,027,387, granted to Kellis, is a device with a housing to place the razor in a hot and cold high water pressure blade cleaner. The unit requires tapping into a water source with a hose and is impractical.

U.S. Pat. No. 4,642,893, granted to Borenstein, uses a throw-a-way aerosol refrigerant container to freeze the blade and prevent molecular movement and corrosion. Aerosol needs refills, is harmful to the environment, and cold can be dangerous to the consumer.

U.S. Pat. No. 5,005,288, granted to Wilk, uses a manually spring operated cleaning and sharpening strip which slides over the blade to remove debris and corrosive substances. This invention does not stop corrosion, and the consumer may forget to press the device.

The above devices are often expensive, have a short life before replacement, and are confusing and impractical to use. They all have some type of special movement or spray action that is added to the traditional shaving process. The consumer may easily forget to use the invention correctly. These inventions have produced some positive results; however, the corrosion of razor blade cutting edges remain an economic problem for the consumer due to the frequent need for replacement.

The concept and theory of this invention's novel permanent magnetic field saturation treatment method is essentially contradictory to the aforementioned invention patents.

SUMMARY OF THE INVENTION

The inventors have determined that the useful shaving life of safety razor blades can be greatly extended if the blade's cutting edge is subjected before, during, and after each use to the strongest area of a permanent magnetic field.

The presence of water shaving solutions on unprotected areas of the razor blade's cutting edge causes corrosion rusting and pitting damage. This results in a jagged irregular cutting edge and is the main cause of dull edge razor blades.

The inventors have overcome this problem of cutting edge corrosion damage by the development of a permanent magnet apparatus which utilizes a novel permanent magnetic field saturation treatment method. The treatment method of this invention forms a protective magnetic field energy barrier which greatly reduces the occurence of corrosion rusting and pitting damage to the fine cutting edge of the razor blade. The invention's treatment method accomplishes this by reducing molecular disturbances within the cutting edge, by removing corrosive solutions from the cutting edge in a dehydration action, and by neutralizing the electrochemical corrosion attack on the razor blades fine cutting edge.

Accordingly, it is an object of the invention to provide a permanent magnet apparatus which prevents corrosion rusting and pitting damage to the cutting edge of safety razor blade shaving devices.

Another object is to provide an apparatus which can accommodate virtually every razor blade safety shaving device with one or more cutting edges.

Another object is to provide an apparatus which does not require expensive refills, aerosol sprays, electricity, high pressure hot or cold water connections, or complicated operational procedures.

Another object is to provide a apparatus which is inexpensive and easy to manufacture.

An object of this invention is to provide an apparatus which is safe for the consumer to use and has a very long lifespan.

An object of the invention is to provide an apparatus which utilizes the novel permanent magnetic field saturation treatment method of the present invention.

Another object of the invention is to greatly extend the useful shaving life of safety razor blades providing an economic benefit to the consumer.

DETAILED DESCRIPTION AND SPECIFICATIONS OF THE PREFERRED EMBODIMENTS

Before proceeding with a detailed description of the present invention, the specifications of the invention method and preferred embodiments of FIGS. 1-8 are set forth. This invention method apparatus comprises permanent magnet embodiments arranged in a polarized configuration embodiment for preserving for further use the cutting edge of razor blades contained within safety razor shaving systems. The invention apparatus comprises an insulated housing embodiment with a receiving cradle embodiment for the placement and storage of the razor blade cutting edges while undergoing the inventions novel permanent magnetic field saturation treatment method.

The permanent magnet embodiments of this invention comprise magnets which retain their permanent magnetic field long after the magnetizing force is removed. This magnetic field embodiment comprises the invisible force field that surrounds a magnet. The permanent magnet embodiments comprise materials which interact with other magnets and materials that retain their magnetization. These permanent magnet embodiments comprise magnets that are magnetized on their largest dimension and are very resistant to demagnetization. The shape and size of these permanent magnet embodiments are determined by the job to be performed. The choice of these permanent magnet material embodiments are usually determined by their cost and availability. These permanent magnet embodiments are often attached in pairs, see FIG. 2 embodiment 1 and embodiment 2, and are held together by magnetic attraction embodiments between opposite magnetic poles. Permanent magnet embodiments, when attached in pairs, have a large increase in their magnetic field attraction strength for ferromagnetic materials. This increase in magnetic field attraction strength embodiment for ferromagnetic material is due to the close proximity between each permanent magnet embodiments opposite polarity magnetic pole embodiments. The increase in attraction strength embodiment varies with distance between opposite magnetic pole embodiments and also varies proportionately as the product of the strength of the magnetic pole embodiments. These permanent magnet embodiments are also held together by an adhesive bonding between magnetically attracted poles. Magnetic pole embodiments are designated as North Pole by the letter N and South Pole by the letter S. These North Pole embodiments and South Pole embodiments are the strongest areas of a magnetic field.

The present inventions permanent magnetic embodiments comprise magnets manufactured from magnetic materials which are very resistant to demagnetization. These permanent magnet embodiments comprise magnets which are magnetized on their largest dimension with only one magnetic pole on the same dimension.

Figure 1:
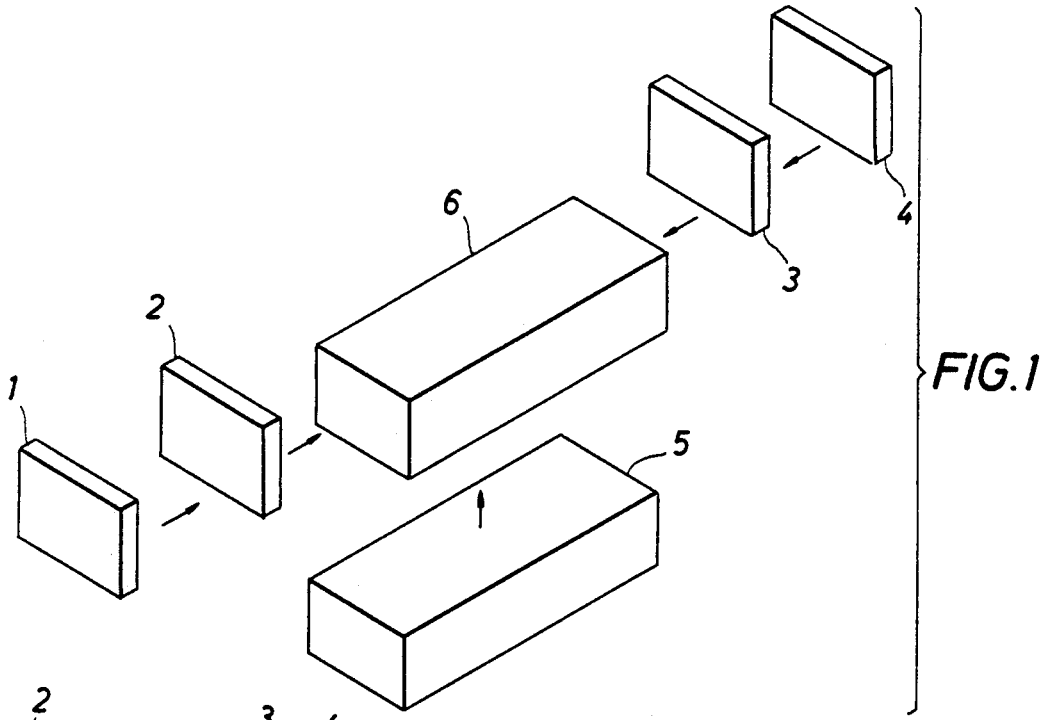
FIG. 1 is an exploded view illustrating the permanent magnet embodiments.

A preferred embodiment of this invention is a polarized configuration embodiment, see FIG. 1, comprising permanent magnet embodiments held together by magnetic attraction embodiments and adhesive bonding which concentrates the strongest areas of magnetic field attraction embodiment energy between the magnetic North Pole embodiment and magnetic South Pole embodiment into the receiving cradle embodiment. The receiving cradle embodiment, FIG. 3 embodiment 8, of this invention comprises an open placement area located within the inventions permanent magnet polarized configuration embodiment which has the strongest magnetic field attraction embodiment for ferromagnetic materials. This receiving cradle embodiment comprises a storage area for razor blade cutting edges while undergoing the inventions permanent magnetic field saturation treatment method embodiment. The placement of razor blade cutting edges within the receiving cradle embodiment subjects the cutting edges to the strongest areas of the permanent magnetic field embodiment.

Ferromagnetic materials comprise materials which are easily magnetized. Ferromagnetic materials comprise materials which display ferromagnetism such as various forms of iron, steel, cobalt, nickel and their alloys. Ferromagnetic materials comprise materials that are attracted toward the strongest part of a magnetic field. Ferromagnetic materials greatly increase the strength of a magnetic field because their individual atoms and molecules act as tiny magnets which can be rotated into alignment with the applied magnetic field.

Figure 2:
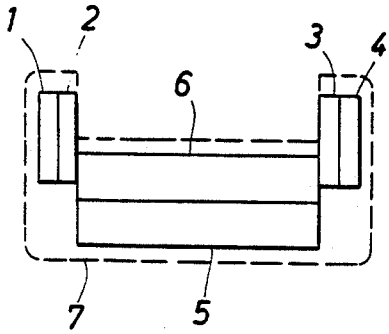
FIG. 2 is a partial side view in outline form of permanent magnet embodiments and the insulated housing embodiment.

An insulated housing embodiment, FIG. 2 embodiment 7, comprises a non-conducting, in, pact resistant, and protective covering embodiment for the invention apparatus preferred embodiments.

The specifications will now be considered which comprise the invention's novel permanent magnetic field saturation treatment method for ferromagnetic material cutting edges of one or more razor blades contained in safety razor shaving devices.

Figure 4:
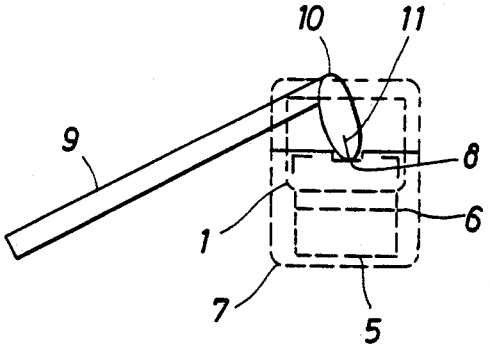
FIG. 4 is a partial end view in outline form showing a safety razor shaving head within the receiving cradle embodiment.

The permanent magnetic field saturation treatment method of the present invention comprises a requirement that the safety razor blade shaving head, FIG. 4 element 10, be placed within the receiving cradle embodiment, FIG. 4 embodiment 8. The receiving cradle embodiment is for placement and storage of the shaving head's razor blade exposed ferromagnetic material cutting edges. The treatment method embodiment of the present invention comprises placement of exposed ferromagnetic material cutting edges, see FIG. 4 element 11, within the receiving cradle embodiment for a minimum of six minutes prior to the first use. These six minutes within the receiving cradle embodiment is the minimum time required for the inventions permanent magnetic field saturation treatment method to preserve for further use razor blade ferromagnetic material cutting edges. Placement within the receiving cradle embodiment comprises subjecting the ferromagnetic material cutting edge to the strongest areas of the magnetic attraction embodiment of the permanent magnetic field embodiment of the invention. The ferromagnetic material cutting edge now becomes the path of least opposition to the flow of the magnetic lines of force embodiment leaving the receiving cradle embodiment magnetic North Pole surface area embodiment.

Magnetic field embodiments are similar to electric fields in that their lines of force embodiments follow the path of least opposition. These lines of force embodiments become very concentrated at the ferromagnetic material cutting edge of the razor blade. These lines of force embodiments con, rise the magnetic field embodiment. Magnetic field embodiments comprise invisible force fields which surround a permanent magnet embodiment. The closer together the lines of force embodiments are, the stronger the magnetic field embodiment. Magnetic pole embodiments comprise the beginning and ending points for these magnetic lines of force embodiments. These lines of force embodiments move out at a right angle from the North Pole embodiment and in at a right angle to the South Pole embodiment. North Pole embodiments are labeled by the letter N and South Pole embodiments are labeled by the letter S.

The inventions permanent magnetic field saturation treatment method comprises subjecting the razor blades ferromagnetic material cutting edges to the strongest areas of a permanent magnetic field embodiment before, during, and after each use. The strongest areas of a permanent magnetic field comprises magnetic North Pole embodiments and magnetic South Pole embodiments. The inventions permanent magnetic field saturation treatment method occurs before and after each shaving use when the ferromagnetic material cutting edge is stored within the receiving cradle embodiment. The invention permanent magnetic field saturation treatment method occurs during the shaving process due to the ferromagnetic material cutting edges strong magnetization. The entire ferromagnetic material cutting edge is a magnetic pole of the razor blades own permanent magnetic field when away from the receiving cradle embodiments strong permanent magnetic field magnetizing force embodiment.

The invention treatment method embodiment for ferromagnetic material razor blade cutting edges comprises a magnetic induction embodiment and a saturation magnetization embodiment. This magnetic induction embodiment comprises subjecting the ferromagnetic material cutting edge to the strongest areas of the invention's permanent magnetic field embodiment which produces a magnetic pole polarity of the ferromagnetic material cutting edge being magnetized opposite that of the receiving cradle embodiments adjacent pole polarity magnetizing force embodiment.

The saturation magnetization embodiment of the invention comprises magnetization of the highest value where the ferromagnetic material cutting edge atoms and molecules are permanently aligned in a North-/South direction. This North/South alignment of molecules embodiment is known as the Molecular Theory of Magnetism. This saturation magnetization embodiment makes the ferromagnetic material cutting edge develop strong permanent magnet effects. The short time used for shaving while the invention treatment method magnetic pole ferromagnetic material cutting edge is away from the receiving cradle embodiment greatly reduces the occurence of corrosion rusting and pitting damage.

To understand how the invention's permanent magnetic field saturation treatment preserves ferromagnetic material cutting edges for further use an explanation of the corrosion rusting and pitting process is required.

Rusting comprises corrosion of iron and steel to form hydrated iron oxide. Rusting occurs only in the presence of water and oxygen. Rusting comprises an electrochemical process in which different parts of the unprotected cutting edge surface act like electrodes and free electrons are released. This rusting corrosion is the first stage of the electrochemical attack on the razor blades fine cutting edge. This rusting corrosion is accelerated into pitting when water electrolyte shaving solutions are allowed to accumulate on the unprotected areas of the cutting edge surfaces. This unprotected surface area is usually due to scratches in the protective films caused by the shaving process.

Corrosion pitting damage comprises the second stage of the electrochemical corrosion attack which destroys the shaving quality of the cutting edge. The principle factors in this accelerated pitting process are the fine stainless steel blades susceptability to pitting action, the strength of the corrosion electrolyte water shaving solution, the length of time the electrolyte water solution contact the cutting edge, the damage to the cutting edge, and the damage to the protective surface films. The wet corrosion dissolution process which occurs within these pits produce autocatalytic conditions which stimulate and continue the pitting process. Corrosion pitting is an extremely localized attack and results in a jagged irregular dull edge shaving surface. Pitting is one of the most destructive forms of corrosion and is very difficult to prevent.

The inventions treatment method embodiment comprises preserving ferromagnetic material cutting edges against corrosion rusting and pitting damage by neutralizing the electrochemical corrosion attack process. The invention's permanent magnetic field saturation treatment method neutralizes the electrochemical corrosion attack process by preventing cutting edge free electrons from flowing into contacting water electrolyte shaving solutions; thereby greatly reducing the occurence of corrosion rusting and pitting damage.

Ordinary tap water is a conductor of electricity, and the added shaving chemicals turn this water solution into a strong electrolyte. Electrolytes conduct electricity, and their presence on unprotected areas of the razor blade cutting edge causes electrochemical corrosion. Water is a diamagnetic substance, and diamagnetic substances are repelled from the strongest area of a permanent magnetic field embodiment. The invention method treated ferromagnetic material cutting edge, while in the receiving cradle embodiment, repells the water electrolyte shaving solution in a dehydration action. This dehydration action embodiment helps preserve the cutting edge by removing the corrosion causing water electrolyte shaving solution. This dehydration action embodiment also prevents the formation of dangerous water born bacteria and fungus growth on the cutting edge. This dehydration action embodiment turns any moist shaving debris remaining on the cutting edge into harmless dry inert flakes.

This invention method dehydration action embodiment of the ferromagnetic material cutting edge does not remove the water electrolyte shaving solution intermediately. The remaining water electrolyte solution would normally absorb free electrons and metallic ions from the cutting edge. Placing the ferromagnetic material cutting edge within the invention's receiving cradle's embodiment strongest permanent magnetic field area embodiment halts this loss of free electrons into the contacting electrolyte water shaving solution. The influence of the strong outside permanent magnetic field embodiment of the invention's receiving cradle embodiment causes cutting edge free electrons to travel in a circular path between collisions with atoms as they move through the razor blade. Free electrons travelling in a circular path are equivalent to a current flowing in a circular wire with a magnetic moment. This free electron flow within the cutting edge is now in opposition to the invention's receiving cradle embodiment strongest area of induced permanent magnetic field embodiment. This effect is called diamagnetism and was first used by Michael Faraday in 1845. A strong outside magnetic field embodiment slows down and speeds up the free electron spin in a manner that the free electron flow will oppose the action of the outside permanent magnetic field embodiment of the invention. These cutting edge free electrons are forced to stay within the razor blade but are repelled away from the cutting edge area. Halting the loss of cutting edge free electrons and then metallic ions to the contacting electrolyte water shaving solution ions neutralizes the electrochemical corrosion process and helps preserve the cutting edge against corrosion rusting and pitting damage. This invention method free electron diamagnetic repelling action embodiment can be hidden by a weak magnetic attraction embodiment called paramagnetism and strong magnetic attraction embodiment known as ferromagnetism.

The inventions permanent magnetic field saturation treatment method embodiment strengthens the structural quality of the ferromagnetic material cutting edge. The inventions method saturation magnetization embodiment permanently aligns the ferromagnetic material cutting edge atoms and molecules in a North/South alignment. This North/South alignment embodiment increases the elasticity of the ferromagnetic material cutting edge by helping return the atoms and molecules to their original position after the bending stress caused by the shaving process. This return of atoms and molecules to their original position is due to magnetic remanance. The magnetic remanance embodiment comprises the magnetization remaining in a ferromagnetic material after the magnetizing force is removed. This magnetic remanence embodiment also reduces molecular disturbances within the ferromagnetic material cutting edge which would normally contribute to corrosion rusting and pitting damage.

The specifications will now be considered which comprise the invention permanent magnetic field saturation treatment method for preserving razor blade cutting edges manufactured from paramagnetic materials and diamagnetic materials.

Paramagnetic material cutting edges comprise materials which become only slightly magnetized even though they are under the influence of a strong magnetizing field. This slight magnetization is in the same direction as the magnetizing field. Paramagnetic material cutting edges of this type comprise aluminum, chromium, manganese, and platinum.

Diamagnetic material cutting edges comprise materials that can also be only slightly magnetized when under the influence of a very strong magnetizing field. Diamagnetic material cutting edges comprise materials, when slightly magnetized, are magnetized in a direction opposite to the external magnetizing field. Diamagnetic material cutting edges comprise antimony, copper, gold, silver, and zinc.

The corrosion rusting and pitting damage process caused by water electrolyte shaving solutions present on the ferromagnetic material cutting edges is not the same for paramagnetic material and diamagnetic material cutting edges.

The electrochemical corrosion attack of paramagnetic material cutting edges and diamagnetic material cutting edges is determined by free electron flow in the cutting edge material. Stopping the flow of cutting edge free electrons into the contacting water electrolyte shaving solution halts the corrosion process. Corrosion of paramagnetic material cutting edges and diamagnetic material cutting edges is in the form of an oxide coating adjacent to the metal surface. This oxide adheres to the metal surface so tightly that it serves to protect against further corrosion and pitting damage. The wet corrosion process caused by contacting water electrolyte shaving solutions, however, penetrate this oxide coating and causes corrosion pitting damage. The invention method dehydration action embodiment repells these diamagnetic water electrolyte shaving solutions from the cutting edge and halts this wet corrosion pitting damage.

The inventions permanent magnetic field saturation treatment method for paramagnetic material and diamagnetic material cutting edges occurs only while these cutting edges are stored within the invention's receiving cradle embodiments strongest permanent magnetic field area embodiment. This is different from the invention method treated ferromagnetic material cutting edge which becomes permanently magnetized. This magnetization embodiment of ferromagnetic material cutting edges enables them to resist corrosion rusting and pitting while away from the invention's receiving cradle embodiment during the shaving process. Paramagnetic material and diamagnetic material cutting edges are not protected against corrosion while away from the invention's receiving cradle embodiment.

FIG. 1 is an exploded view illustrating the permanent magnet embodiments shown in FIGS. 1-5. Side permanent magnet 1 embodiment North Pole surface embodiment is marked by the letter N and is shown facing away from the other magnet embodiments. Magnet 1 embodiment South Pole surface embodiment is shown with a directional arrow denoting the location of attachment by the magnetic attraction embodiment and adhesive bonding to the side permanent magnet 2 embodiment North Pole surface embodiment marked by the letter N. Magnet 2 embodiment South Pole surface embodiment is shown with a directional arrow denoting the location of attachment at a right angle by the magnetic attraction embodiment and adhesive bonding to the narrow end of center permanent magnet 6 embodiment North Pole surface embodiment marked by the letter N. Side permanent magnet 3 embodiment South Pole surface embodiment, marked by the letter S, is shown with a directional arrow denoting the location of attachment at a right angle to the opposite end of magnet 6 embodiment North Pole embodiment by magnetic attraction and adhesive bonding. Magnet 3 embodiment North Pole surface embodiment is shown with a directional arrow denoting the location of attachment by magnetic attraction embodiment and adhesive bonding to side permanent magnet 4 embodiment South Pole surface embodiment marked by the letter S. Center magnet 5 embodiment North Pole surface embodiment, marked by letter N, is shown with a directional arrow denoting the location of attachment to the center magnet 6 embodiment South Pole surface embodiment by magnetic attraction embodiment and adhesive bonding.

FIG. 2 is a partial side view in outline form illustrating the invention apparatus housing embodiment with permanent magnet embodiments of FIG 1. Side permanent magnet 1 embodiment is attached to side permanent magnet 2 embodiment by magnetic attraction embodiment and adhesive bonding. Magnet 2 embodiment is attached at a right angle to center permanent magnet 6 embodiment by magnetic attraction embodiment and adhesive bonding. Magnet 6 embodiment is attached to center permanent magnet 5 embodiment by the magnetic attraction embodiment and adhesive bonding. Side permanent magnet 3 embodiment is attached at a right angle to magnet 6 embodiment by magnetic attraction embodiment and adhesive bonding. Side permanent magnet 4 embodiment is attached to magnet 3 embodiment by magnetic attraction embodiment and adhesive bonding. Insulated impact resistant housing 7 embodiment encloses the polarized configuration embodiment of the permanent magnet embodiments.

Figure 3:
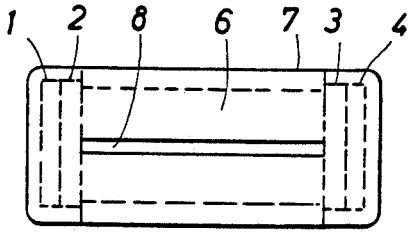
FIG. 3 is a partial top view in outline form of the receiving cradle embodiment within the polarized configuration embodiment.

FIG. 3 is a partial top view in outline form of the permanent magnet embodiments shown in FIG. 1 and FIG. 2 illustrating the receiving cradle 8 embodiment placement in the middle of magnet 6 embodiment North Pole surface embodiment. Receiving cradle 8 embodiment extends the entire length of the largest dimension of magnet 6 embodiment North Pole surface embodiment.

FIG. 4 is a side partial view in outline form of the permanent magnet embodiments shown in FIG. 1-FIG. 3 illustrating the receiving cradle 8 embodiment containing a safety razor shaving device 9. Safety razor 9 has a shaving head 10 placed within the receiving cradle 8 embodiment. The shaving head 11 has an exposed razor blade ferromagnetic material cutting edge 11 placed within the receiving cradle 8 embodiment undergoing the permanent magnetic field saturation treatment method embodiment of the invention.

Figure 5:
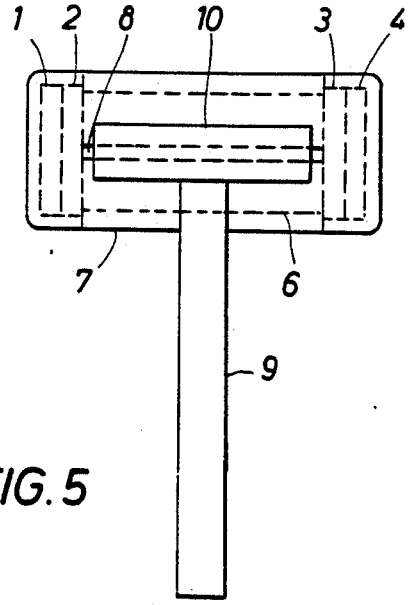
FIG. 5 is a partial top view in outline form of safety razor shaving head within receiving cradle.

FIG. 5 is a partial top view in outline form of the permanent magnet embodiments shown in FIG. 1--FIG.4 showing the present invention preferred embodiments illustrating a safety razor 9 with the shaving head 10 positioned within the receiving cradle 8 embodiment.

Figure 6:
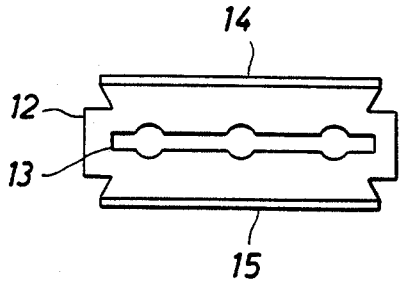
FIG. 6 is a top view of invention method razor blade embodiment.

FIG. 6, another alternative embodiment of the invention, comprises a permanent magnetic field saturation treatment method ferromagnetic material permanent magnet razor blade 12 embodiment. Razor blade 12 embodiment has a center opening 13 embodiment to accomodate various safety razor shaving devices. Razor blade 12 embodiment has a magnetic pole cutting edge 14 embodiment. Razor blade 12 embodiment has an opposite magnetic pole cutting edge 15 embodiment.

Figure 7:
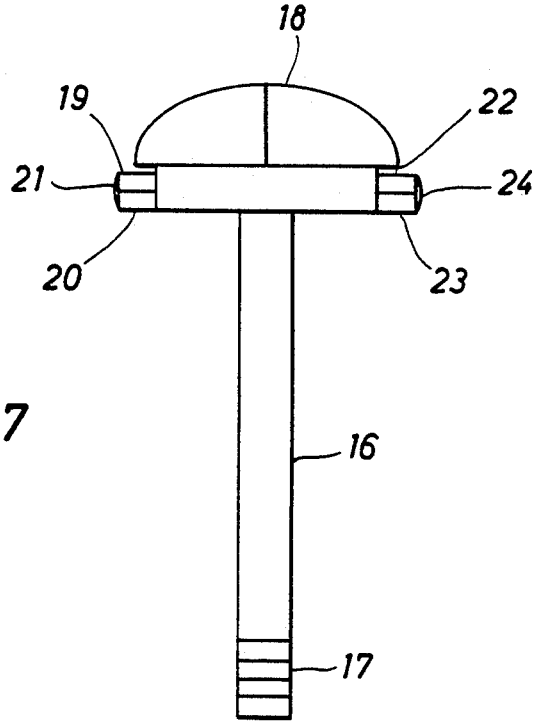
FIG. 7 is a side view of the invention method safety razor shaving device embodiment.

FIG. 7 is a partial side view illustrating an alternative embodiment of the present invention comprising a safety razor shaving device. Safety razor handle 16 embodiment has a turning handle 17 embodiment which opens and closes the shaving head 18 embodiment. The shaving head 18 embodiment is for placement and storage of the exposed cutting edges of the razor blade during the shaving process and while undergoing the invention's permanent magnetic field saturation treatment embodiment. Shaving head 18 embodiment has an exposed cutting edge placement area 19 embodiment located directly above the strongest area of the magnetic North Pole surface embodiment of the rectangular permanent magnet pair 20 embodiment, magnet pair 20 embodiment is attached to the razor shaving head 18 embodiment by adhesive bonding. A skin guard 21 embodiment is attached to the outer surface of magnet pair 26 embodiment by adhesive bonding. The exposed cutting edge placement area 22 embodiment is positioned directly above the strongest area of the magnetic South Pole surface embodiment of rectangular permanent magnet pair 23 embodiment. Magnet pair 23 embodiment is attached to shaving head 18 embodiment by adhesive bonding. The skin guard 24 embodiment is attached to the outer side of magnet pair 23 embodiment by adhesive bonding.

Figure 8:
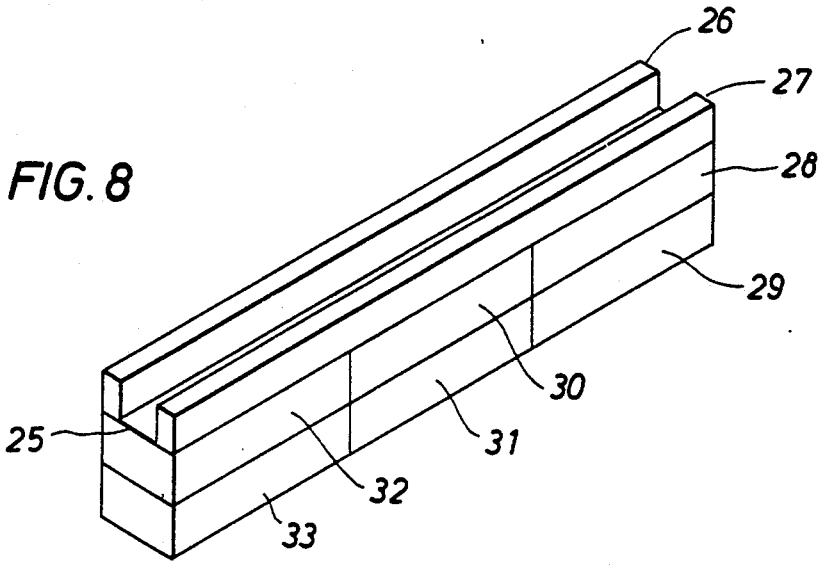
FIG. 8 is another variation of the invention method polarized configuration embodiment.

FIG. 8 illustrates another polarized configuration embodiment of the present invention for use with ferromagnetic material cutting edge devices comprising a receiving cradle 25 embodiment, a receiving cradle cutting edge guide 26 embodiment and a receiving cradle cutting edge guide 27 embodiment. The cutting edge guides 26 and 27 are attached to the North Pole surface of rectangular permanent magnet 28 embodiment, cutting edge guides 26 and 27 are attached to the South Pole surface of rectangular permanent magnet 30 embodiment, cutting edge guide 26 and 27 are attached to the North Pole surface of rectangular permanent magnet 32 embodiment. The rectangular permanent magnet 29 embodiment North Pole surface is attached to magnet 28 South Pole surface, rectangular permanent magnet 31 embodiment South Pole surface is attached to the North Pole surface of magnet 30, rectangular permanent magnet 33 embodiment North Pole surface is attached to the South Pole surface of magnet 32.

Operation of the permanent magnetic field saturation treatment method and permanent magnet apparatus embodiment of the invention in relation to a safety razor blade shaving device is now considered. The invention treatment method embodiment requires the safety razor 9 embodiment, as illustrated in FIG. 4, to be placed with the ferromagnetic material cutting edge 11 embodiment within the receiving cradle 8 embodiment. The ferromagnetic material cutting edge 11 embodiment requires a minimum of six minutes of the invention treatment method embodiment within the receiving cradle 8 embodiment before the first shave. The invention method treated ferromagnetic material cutting edge 11 embodiment is changed into the magnetic South pole embodiment of the razor blades own permanent magnet field. This opposite pole polarity of the razor blades ferromagnetic material cutting edge comprises the invention methods magnetic induction embodiment. This magnetic induction embodiment will always produce a pole polarity on the ferromagnetic material cutting edge being magnetized opposite that of the adjacent magnetic pole of the magnetizing force. The safety razor 9 embodiment is removed from the receiving cradle 8 embodiment during the shaving process. The cutting edge 11 embodiment must be rinsed with running water to remove shaving debris then shaken to remove excess moisture before being replaced within the receiving cradle 8 embodiment. The cutting edge 11 embodiment should be placed within the receiving cradle 8 embodiment as soon as possible after the shaving process is completed, The cutting edge 11 embodiment must be stored within the receiving cradle 8 embodiment until used by the consumer for the next shave.

In an alternative embodiment of the present invention, as illustrated in FIG, 6, operation of the invention's permanent magnetic field saturation treatment embodiment comprises a permanent magnet ferromagnetic material razor blade 12 embodiment. Razor blade 12 embodiment has a center opening 13 embodiment to accomodate various safety razor shaving devices. The ferromagnetic material razor blade 12 embodiment has been subjected to the invention's permanent magnetic field saturation treatment and has been changed into a permanent magnet embodiment with two magnetic pole embodiments. The cutting edge magnetic pole 14 embodiment has an opposite magnetic polarity of cutting edge 15 embodiments magnetic pole polarity. The invention method treated razor blade 12 embodiment is used in place of standard razor blades.

In the alternative embodiment of the present invention a safety razor is illustrated in FIG. 7. The operation of the safety razor shaving device embodiment of FIG. 7 comprises placement of a razor blade with cutting edges within the shaving head 18 embodiment. The razor blade is positioned with one exposed cutting edge located in the cutting edge placement area 19 embodiment. This subjects that cutting edge to the strongest area of the magnetic North Pole field embodiment of rectangular permanent magnet pair 20 embodiment. The opposite cutting edge is placed in the exposed cutting edge placement area 22 embodiment. This subjects that cutting edge to the strongest area of the magnetic South Pole field embodiment of permanent magnet pair 23 embodiment. The razor blade exposed cutting edges, when correctly positioned in the shaving head 18 embodiment, undergoes the inventions permanent magnetic field saturation treatment method.

An alternative embodiment of the present invention is illustrated in FIG. 8 comprising a polarized configuration embodiment to accomodate various ferromagnetic material cutting edge devices. Ferromagnetic material cutting edge devices comprise razors, electric razors, chisels, cutlery, drills, edge tools, knives, needles, planers, saws, scalpels, and cutting tools. Ferromagnetic material cutting edge devices are positioned with the cutting edge within the receiving cradle 25 embodiment while undergoing the invention's permanent magnetic field saturation treatment method. The invention method treated ferromagnetic material cutting edge devices which extend the entire length of receiving cradle 25 embodiment are changed into permanent magnet embodiments with more than two magnetic pole embodiments. These additional magnetic pole embodiments are known as consequent pole embodiments.

Having now described and shown particular embodiments of the invention, various modifications may be apparent to those skilled in the art and therefore is not intended that the invention be limited to the details thereof and departures may be made therefrom within the spirit and scope of the claims.

What is claimed is:

1. A magnet apparatus in combination with a razor blade having a cutting edge, said magnet apparatus comprising:

a first permanent magnet polar surface having two opposite ends;

a second permanent magnet polar surface being situated at one of said ends;

a third permanent magnet polar surface being situated at the other of said ends;

said second and third polar surfaces having the same polarity and being of an opposite polarity to the first polar surface;

said first, second and third polar surfaces defining a receptacle;

said razor blade being held in said receptacle;

said cutting edge having its length situated in close proximity to said first polar surface; and each of said second and third polar surfaces being in proximity to an end of said length of said cutting edge.

2. The apparatus of claim 1, wherein the first permanent magnet polar surface comprises a surface formed from two permanent magnets attached together in series with opposite poles juxtaposed.

3. The apparatus of claim 1 wherein the second and third permanent magnet polar surfaces each comprise a surface formed from attaching together two permanent magnets in series with opposite poles juxtaposed.

4. The apparatus of claim 1 wherein the first, second and third permanent magnet polar surfaces are partially enclosed within a wooden housing.

5. The apparatus of claim 1 wherein the charge of said first permanent magnet polar surface is magnetic North.

6. A method for extending the life of razor blade cutting edge comprising:

attaching second and third permanent magnets to a first permanent magnet such that polar surfaces of the second and third magnets are located at opposite ends of a polar surface of the first magnet and wherein the charge of said polar surface of the first magnet is opposite to the charge of said polar surfaces of the second and third magnets;

providing a razor blade; and placing a cutting edge of the razor blade proximate the polar surface of the first magnet with the length of the cutting edge of the blade running between said polar surfaces of the second and third magnets.

7. The method of claim 6 wherein the attaching of the second and third permanent magnets to the first permanent magnet includes attaching magnetic South polar surfaces of the second and third magnets to opposite ends of a magnetic North polar surface of the first magnet.

* * * * *